United States Patent [19]

Patel

[11] Patent Number: 4,900,230

[45] Date of Patent: Feb. 13, 1990

[54] LOW PRESSURE END BLADE FOR A LOW PRESSURE STEAM TURBINE

[75] Inventor: Ashok T. Patel, Orlando, Fla.

[73] Assignee: Westinghouse Electric Corp., Pittsburgh, Pa.

[21] Appl. No.: 344,136

[22] Filed: Apr. 27, 1989

[51] Int. Cl.[4] ..... F01D 5/14

[52] U.S. Cl. ..... 416/223 A; 416/DIG. 2; 415/181

[58] Field of Search ... 416/223 A, 223 R (U.S. only), 416/228, DIG. 2; 415/181

[56] References Cited

U.S. PATENT DOCUMENTS

| | | | |
|---|---|---|---|
| 2,258,793 | 10/1941 | New | 416/223 A |
| 2,934,259 | 4/1960 | Hausmann | 415/181 |
| 3,475,108 | 10/1969 | Zickuhr | 416/223 A X |
| 3,529,631 | 9/1970 | Riollet | 416/223 A X |
| 3,565,548 | 2/1971 | Fowler et al. | 416/223 A |
| 4,080,102 | 3/1978 | Schwab | 416/223 A |
| 4,626,174 | 12/1986 | Sato et al. | 416/223 A |

FOREIGN PATENT DOCUMENTS

| | | | |
|---|---|---|---|
| 2451453 | 11/1980 | France | 416/223 A |
| 114619 | 9/1979 | Japan | 416/223 A |
| 14802 | 2/1981 | Japan | 416/223 A |
| 252702 | 8/1927 | United Kingdom | 415/181 |

*Primary Examiner*—Everette A. Powell, Jr.
*Attorney, Agent, or Firm*—K. Bach

[57] ABSTRACT

Replacement low pressure end blading for a utility power steam turbine having an extended length compared to original equipment end blading providing higher efficiency. The blading incorporates extended flat areas on the blade trailing edge for improved flow characteristics and reduced losses. Mass distribution is used to tune the blade to avoid natural harmonic frequencies coincidental with turbine rotational frequencies or harmonics thereof. Blade root modifications are included to facilitate installation.

2 Claims, 3 Drawing Sheets

LOW PRESSURE END BLADE FOR A LOW PRESSURE STEAM TURBINE

BACKGROUND OF THE INVENTION

This invention relates to steam turbines and, more particularly, to an end blade for optimizing performance of a final stage of turbine blading.

The traditional approach to meeting the needs of electric utilities over the years was to build larger units requiring increased exhaust annulus area with successive annulus area increases of about 25%. In this way, a new design with a single double flow exhaust configuration would be offered instead of an older design having the same total exhaust annulus area but with two double flow LP turbines. The newer design would have superior performance in comparison to the old design because of technological advances.

In recent years, the market has emphasized replacement blading on operating units to extend life, to obtain the benefits of improvied thermal performance (both output and heat rate), and to improve reliability and correction of equipment degradation. In addition, the present market requires upgraded versions of currently available turbine designs with improved reliability, lower heat rate and increased flexibility.

The latter stages of the steam turbine, because of their length, produced the largest proportion of the total turbine work and therefore have the greatest potential for improved heat rate. The last turbine stage operates at variable pressure ratio and consequently the stage design is extremely complex. All of the first turbine stage, if it is a partial-arc admission design, experiences a comparable variation in operating conditions. In addition to the last stage, the upstream low pressure (LP) turbine stages can also experience variations on operating conditions because of: (1) differences in rated load end loading; (2) differences in site design exhaust pressure and deviations from the design values; (3) hood performance differences on various turbine frames; (4) LP inlet steam conditions resulting from cycle steam conditions and cycle variations; (5) location of extraction points; (6) operating load profile (base load versus cycle); and (7) zoned or multi-pressure condenser applications versus unzoned or single pressure condenser applications. Since the last few stages in the turbine are tuned, tapered, twisted blades with more selected inlet angles, the seven factors identified above have greater influence in stage performance. Consequently, it is desirable to design last row blades for low pressure steam turbines in a manner to meet the requirements of the above listed seven factors.

SUMMARY OF THE INVENTION

It is an object of the present invention to provide an end blade for a low pressure steam turbine which optimizes efficiency of the end blading.

The present invention, in one form, comprises end blading for a low pressure steam turbine which has been extended in length as compared to prior blades used in the same design steam turbine. In addition, the end blading incorporates an extended flat area along a trailing edge to provide improved flow and reduced losses across the end blading. The end blading is tuned in three different modes, i.e., for vibration in a tangential direction, for vibration in an axial direction and for vibration in a torsional (twist) direction. The blade is tuned so that its natural frequency is distinct from harmonics of turbine running speed. The blade is tuned by shifting mass distribution within the blade to change its natural resonant frequency. In addition, the blade root is modified to give larger clearances under the platform to allow easier installation during retrofit application of the turbine blade.

BRIEF DESCRIPTION OF THE DRAWINGS

For a better understanding of the present invention, reference may be had to the following detailed description taken in conjunction with the accompanying drawings in which.

DETAILED DESCRIPTION OF THE PREFERRED EMBODIMENT

Figure 1:
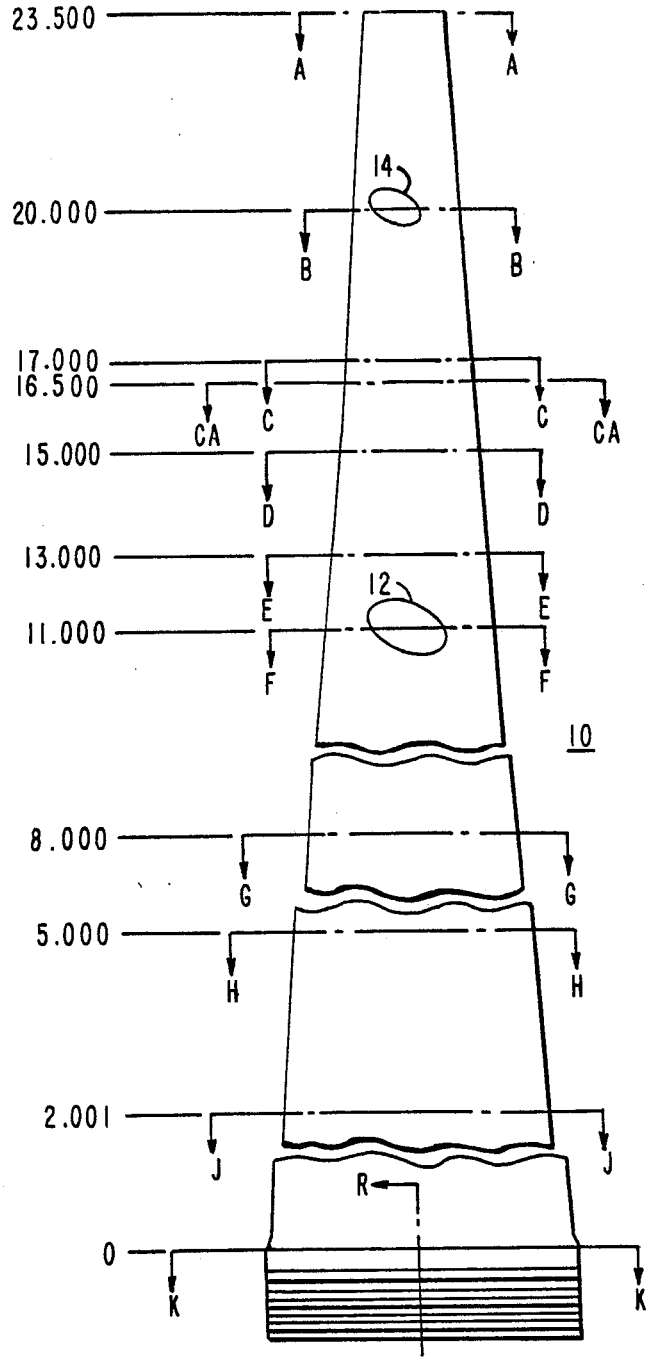
FIG. 1 is a view of the blade taken transverse to the normal plane of rotation and indicating a plurality of section lines used for establishing a blade profile.
Figure 5:
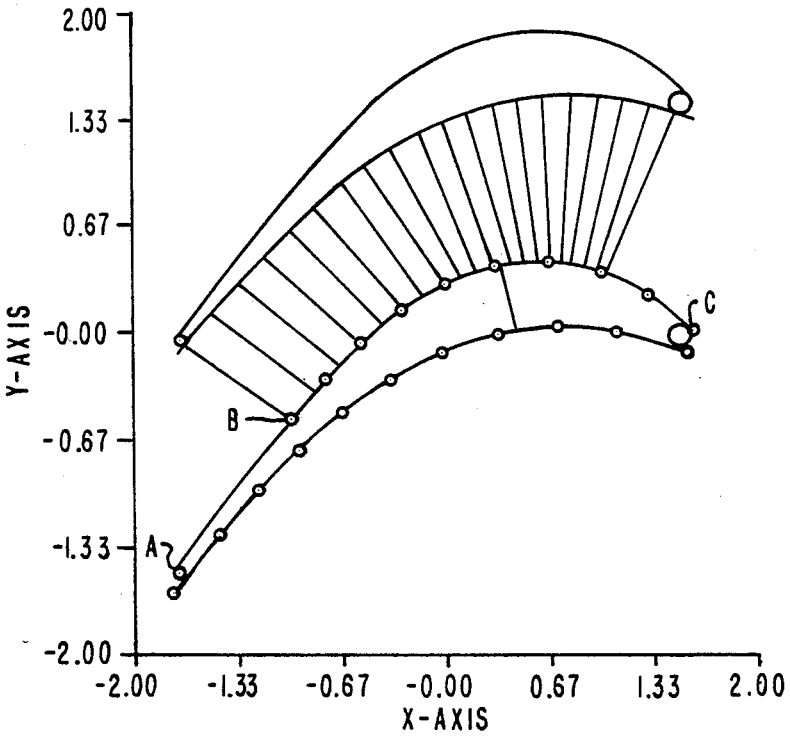
FIG. 5 is a computer generated graphical representation of a pair of turbine blades in accordance with the present invention indicating the extent of the flat trailing edge of the inventive blade.

Referring now to FIG. 1, there is shown a view of the blade taken transverse to the normal plane of rotation of the blade. In this plane, the blade 10 is essentially a tapered blade having a pair of connecting points located at section F—F and section B—B for attaching the blade to adjacent blades. Preferably, the blades are grouped in groups of four and tuned in such groups to avoid resonance in the tangential, axial and torsional modes with multiple harmonics. The tuning is achieved by mass distribution within the blade to avoid resonance with multiple harmonics. The tuning also is designed to avoid excitation of frequencies at multiples of the turbine speed. The connecting points 12, 14 at B—B and F—F are referred to an inner and outer latching wires and are located at eleven inches and twenty inches above the blade base section. The blade includes a zero taper angle at the base to simplify the manufacturing process. The axial width of the blade base section is 4.25 inches while the axial width of the blade tip section is 1.22 inches. To improve aerodynamic performance during transonic operation, the blades are designed with straight back suction surface from the point of throat to the blade trailing edge. This section can be seen in the computer generated drawing of FIG. 5. The straight back section surface is shown from point A to point B on the blade. From point B to point C at the leading edge of the blade, the blade is essentially a continuous spline.

Figure 2:
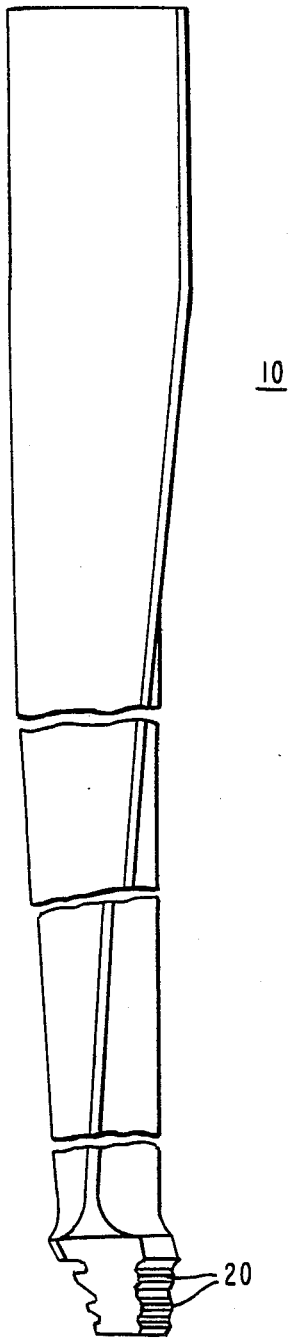
FIG. 2 is a view of the blade of FIG. 1 rotated 90°.

Referring to FIG. 2, it can be seen that the blade root includes a plurality of lugs 20 for supporting the blade in a groove formed in a rotor of a turbine. The radii of the lugs has been modified to provide additional clearance under the platform for ease of installation of the blade into the platform groove.

Figure 3:
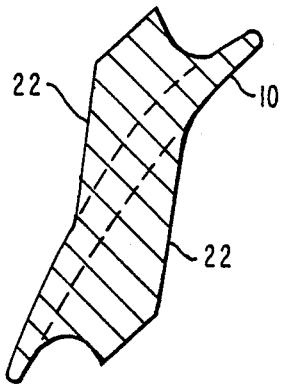
FIG. 3 is a sectional view of the blade taken through the section lines B—B.
Figure 4:
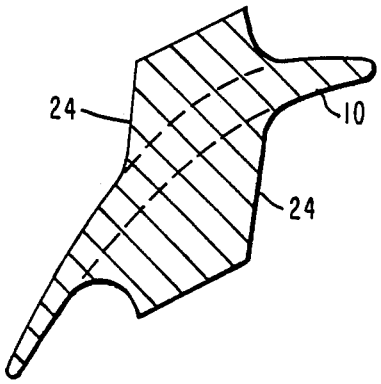
FIG. 4 is a sectional view of the blade of FIG. 1 taken through the section lines F—F.

In the cross-sectional views shown in FIGS. 3 and 4, the two latching wire lugs are shown at 22 and 24. The latching wires are welded to adjacent latching wires of adjacent blades to join the blades into groups of four. Lugs 22 are located at section B—B and luges 24 are located at section F—F.

The blades are designed and tuned in groups to avoid natural frequencies which coincide with the rotational frequency of the rotor to which the blade is attached. In addition, the strength of the blade in various modes of vibration is verified mathematically and then the blade is mechanically excited at resonant condition and all untuned modes of vibration up to the twentieth harmonic of the turbine running speed.

A better understanding of the blade can be had by reference to Table I which shows the dimensions of the blade taken at the cross-section lines indicated in FIG. 1. Note that the Table also specifies the inlets and exit openings between adjacent blades. These blades are arranged, as described above, in groups of four with 120 blades forming a blade row in one embodiment. The pitch and inlet/exit angles precisely define the arrangement of blades.

While the present invention has been described in what is considered to be a preferred embodiment, it is intended that it not be limited by the disclosed implementation but be interpreted within the full spirit and scope of the appended claims.

| | POSITION (IN. FROM ROOT) | | | | |
|---|---|---|---|---|---|
| | 0.0000 | 2.0010 | 5.0000 | 8.0000 | 11.0000 |
| WIDTH (IN) | 4.25000 | 3.98599 | 3.59000 | 3.19487 | 2.80004 |
| CHORD (IN) | 4.27696 | 4.06846 | 3.80152 | 3.57532 | 3.38230 |
| STAGGER ANGLE (DEG) | 5.99407 | 11.14957 | 18.87216 | 26.44029 | 34.00799 |
| MAXIMUM THICKNESS (IN) | .49309 | .49336 | .47970 | .44171 | .36554 |
| MAXIMUM THICKNESS/CH | .11528 | .12127 | .12619 | .12354 | .10807 |
| EXIT OPENING ANGLE (IN) | 37.00990 | 37.01522 | 36.77622 | 36.01430 | 34.88362 |
| INLET METAL ANGLE (DEG) | 44.17650 | 47.84891 | 51.44978 | 55.15249 | 61.38140 |
| INLET INCL. | 11.40081 | 16.53943 | 22.84699 | 25.47453 | 25.91233 |

TABLE I

| BB70 L-OR FINAL; SECTION RADIUS (IN) | K-K 21.0000 | J-J 23.0010 | H-H 26.0000 | G-G 29.0000 | F-F E-E 32.0000 | D-D .06632 | C-C 36.0000 | B-B 38.0000 | A-A 41.0000 | 44.5000 |
|---|---|---|---|---|---|---|---|---|---|---|
| 1. WIDTH (IN) | 4.25000 | 3.98599 | 3.59000 | 3.19487 | 2.80004 | 2.53499 | 2.27502 | 2.02001 | 1.63994 | 1.22000 |
| 2. CHORD (IN) | 4.27696 | 4.06846 | 3.80152 | 3.57532 | 3.38230 | 3.27467 | 3.18522 | 3.11362 | 3.02030 | 2.98616 |
| 3. PITCH/WIDTH | .25872 | .30214 | .37921 | .47526 | .59839 | .70227 | .82855 | .98498 | 1.30905 | 1.90985 |
| 4. PITCH/CHORD | .25709 | .29602 | .35811 | .42470 | .49538 | .54364 | .59178 | .63902 | .71078 | .78027 |
| 5. STAGGER ANGLE (DEG) | 5.99407 | 11.14957 | 18.87216 | 26.44029 | 34.00799 | 39.25621 | 44.50158 | 49.74360 | 57.49909 | 66.50863 |
| 6. MAXIMUM THICKNESS(I | .49309 | .49336 | .47970 | .44171 | .36554 | .30734 | .27120 | 34.75539 | .23791 | .19786 |
| 7. MAXIMUM THICKNESS/CH | .11528 | .12127 | .12619 | .12354 | .10807 | .09385 | .08514 | .08157 | .07877 | .06626 |
| 8. TURNING ANGLE(DEG) | 99.00775 | 95.26683 | 91.87936 | 88.86644 | 83.76492 | 77.73416 | 63.48453 | 45.30250 | 22.42356 | 3.15092 |
| 9. EXIT OPENING (IN) | .59287 | .65578 | .74573 | .82308 | .88852 | .91394 | .92833 | .92596 | .87312 | .75481 |
| 10. EXIT OPENING ANGLE | 37.00990 | 37.01522 | 36.77622 | 36.01430 | 34.88362 | 33.54951 | 31.98439 | 30.03656 | 26.06724 | 20.73475 |
| 11. INLET METAL ANGLE(D | 44.17650 | 47.84891 | 51.44978 | 55.15249 | 61.38140 | 68.72656 | 84.54536 | 101.6240 | 131.52230 | 156.12210 |
| 12. INLET INCL. ANGLE(D | 11.40081 | 16.53943 | 22.84699 | 25.47453 | 25.91233 | 24.68350 | 22.48244 | 21.19228 | 17.00538 | 12.38879 |
| 13. EXIT METAL ANGLE(DE | 36.81575 | 36.88426 | 36.67086 | 35.98107 | 34.85368 | 33.53928 | 31.97012 | 30.03510 | 26.05414 | 20.72697 |
| 14. EXIT INCL. ANGLE(DE | −.36321 | −.26176 | −.21057 | −.06632 −.05841 | −.0.02031 | −.01361 | −.00290 | −.00751 | −.01513 | |
| 15. SUCTION SURFACE TURN | .01252 | .00007 | .00007 | .00006 | .00072 | .00007 | .00746 | .00002 | .00920 | .00020 |
| 16. AREA(IN**2) | 1.59755 | 1.46661 | 1.24542 | 1.02627 | .75902 | .64368 | .54398 | .49238 | .44678 | .38695 |
| 17. ALPHA (DEG) | 2.32645 | 7.98010 | 17.19555 | 27.24394 | 36.35089 | 41.96792 | 47.07823 | 51.99890 | 58.93754 | 67.16779 |
| 18. FX (IN**(−4)) | .58790 | .85758 | 1.89608 | 5.06472 | 14.65036 | 33.54171 | 73.28596 | 156.72040 | 410.31290 | 1125.08400 |
| 19. FY (IN**(−4)) | 6.73463 | 7.85927 | 10.37945 | 15.39305 | 25.44271 | 40.92631 | 63.75584 | 96.90266 | 152.39400 | 202.78640 |
| 20. FXY (IN**(−4)) | .25013 | 1.00122 | 2.90337 | 7.23665 | 17.32703 | 34.75539 65.56981 | 119.97750 | 245.89130 | 471.97020 | |
| 21. I TOR (IN**(−4)) | .08412 | .07587 | .05812 | .03850 | .01983 | .01159 | .00672 | .00606 | .00460 | .00288 |
| 22. I MIN (IN**(−4)) | .14826 | .12501 | .08867 | .05230 | .02618 | .01385 | .00745 | .00399 | .00179 | .00076 |
| 23. I MAX (IN**(−4)) | 1.73090 | 1.39427 | 1.00242 | .74707 | .52668 | .43801 | .35995 | .31623 | .27049 | .24534 |
| 24. X BAR | −.00058 | −.00652 | .01980 | .00451 | .01969 | −.01022 | −.02008 | −.01986 | .01471 | .01865 |
| 25. Y BAR | .00026 | −.00594 | .01890 | .00473 | .01977 | −.02021 | −.02215 | −.02510 | −.02048 | .01915 |
| 26. ZMINLE (IN**3) | −.18206 | −.16007 | −.12497 | −.08167 | −.04801 | −.03031 | −.02025 | −.01422 | −.01034 | −.00940 |
| 27. ZMAXLE (IN**3) | .81489 | .73306 | .67205 | .56553 | .44324 | .36516 | .30290 | .26391 | .22716 | .20271 |
| 28. ZMINTE (IN**3) | −.14026 | −.12898 | −.10948 | −.08934 | −.06412 | −.04616 | −.03321 | −.02463 | −0.1722 | −.01423 |
| 29. ZMAXTE (IN**3) | −.77418 | −.62188 | −.44142 | −.33700 | −.24438 | −.21485 | −.18402 | −.16882 | −.15179 | −.14165 |
| 30. CMINLE (IN**3) | −.81435 | −.78097 | −.70950 | −.64040 | −.54539 | −.47505 | −.36699 | −.28084 | −.17292 | −.08039 |
| 31. CAMXLE (IN**3) | 2.12406 | 1.90199 | 1.49159 | 1.32100 | 1.8827 | 1.19950 | 1.18834 | 1.19822 | 1.19072 | 1.21031 |
| 32. CMINTE (IN**3) | −1.05706 | −.96921 | −.80994 | −.58547 | −.40831 | −.30012 | −.22427 | −.16208 | −.10386 | −.05309 |
| 33. CMAXTE (IN**3) | −2.23578 | −2.24203 | −2.27090 | −2.21684 | −2.15518 | −2.03868 | −1.95604 | −1.87313 | −1.78200 | −1.73196 |

What is claimed is:

1. Blading for a steam turbine formed in accordance with the following table:

-continued

| | | | | | |
|---|---|---|---|---|---|
| ANGLE (DEG) | | | | | |
| EXIT METAL ANGLE (DEG) | 36.81575 | 36.88426 | 36.67086 | 35.98107 | 34.85368 |
| EXIT INCL. ANGLE (DEG) | −.36321 | −.26176 | −.21057 | −.06632 | −.05841 |
| SUCTION SURFACE TURN AREA (IN**2) | .01252 | .00007 | .00007 | .00006 | .00072 |
| | 1.59755 | 1.46661 | 1.24542 | 1.02627 | .75902 |

| | POSITION (IN. FROM ROOT) | | | | |
|---|---|---|---|---|---|
| | 13.0000 | 15.0000 | 17.0000 | 20.0000 | 23.5000 |
| WIDTH (IN) | 2.53499 | 2.27502 | 2.02001 | 1.63994 | 1.22000 |
| CHORD (IN) | 3.27467 | 3.18522 | 3.11362 | 3.02030 | 2.98616 |
| STAGGER ANGLE (DEG) | 39.25621 | 44.50158 | 49.74360 | 57.49909 | 66.50863 |
| MAXIMUM THICKNESS (IN) | .30734 | .27120 | .25398 | .23791 | .19786 |
| MAXIMUM THICKNESS/CH | .09385 | .08514 | .08157 | .07877 | .06626 |
| EXIT OPENING ANGLE (IN) | 33.54951 | 31.98439 | 30.03656 | 26.06724 | 20.73475 |
| INLET METAL ANGLE (DEG) | 68.72656 | 84.54536 | 101.66240 | 131.52230 | 156.12210 |
| INLET INCL. ANGLE (DEG) | 24.68350 | 22.48244 | 21.19228 | 17.00538 | 12.38879 |

-continued

| | | | | | |
|---|---|---|---|---|---|
| EXIT METAL ANGLE (DEG) | 33.53928 | 31.97012 | 30.03510 | 26.05414 | 20.72697 |
| EXIT INCL. ANGLE (DEG) | −.02031 | −.01361 | −.00290 | −.00751 | −.01513 |
| SUCTION SURFACE TURN AREA (IN**2) | .00007 | .00746 | .00002 | .00920 | .00020 |
| | .64368 | .54398 | .49238 | .44678 | .38695 |

2. The steam turbine blading of claim 1 wherein a plurality of blades are arranged to form a blade row characterized by:

| | POSITION (IN. FROM ROOT) | | | | |
|---|---|---|---|---|---|
| | 0.0000 | 2.0010 | 5.0000 | 8.0000 | 11.0000 |
| PITCH/WIDTH | .25872 | .30214 | .37921 | .47526 | .59839 |
| PITCH/CHORD | .25709 | .29602 | .35811 | .42470 | .49538 |
| EXIT OPENING (IN) | .59287 | .65578 | .74573 | .82308 | .88852 |
| EXIT OPENING ANGLE | 37.00990 | 37.01522 | 36.77622 | 36.01430 | 34.88362 |

| | POSITION (IN. FROM ROOT) | | | | |
|---|---|---|---|---|---|
| | 13.0000 | 15.0000 | 17.0000 | 20.0000 | 23.5000 |
| PITCH/WIDTH | .70227 | .82855 | .98498 | 1.30905 | 1.90985 |
| PITCH/CHORD | .54364 | .59178 | .63902 | .71078 | .78027 |
| EXIT OPENING (IN) | .91394 | .92833 | .92596 | .87312 | .75481 |
| EXIT OPENING ANGLE | 33.54951 | 31.98439 | 30.03656 | 26.06724 | 20.73475 |

* * * * *